US009174180B2

(12) United States Patent
Juha

(10) Patent No.: US 9,174,180 B2
(45) Date of Patent: Nov. 3, 2015

(54) AGITATOR AND A METHOD OF REPLACING A SHAFT SEAL OF AN AGITATOR

(71) Applicant: Sulzer Pumpen AG, Winterthur (CH)

(72) Inventor: Ottelin Juha, Tarvasjoki (FI)

(73) Assignee: SULZER MANAGEMENT AG, Winterthur (CH)

( * ) Notice: Subject to any disclaimer, the term of this patent is extended or adjusted under 35 U.S.C. 154(b) by 40 days.

(21) Appl. No.: 14/245,702

(22) Filed: Apr. 4, 2014

(65) Prior Publication Data

US 2014/0313852 A1 Oct. 23, 2014

(30) Foreign Application Priority Data

Apr. 17, 2013 (EP) ..... 13164161

(51) Int. Cl.

| | |
|---|---|
| ***B01F 15/00*** | (2006.01) |
| ***B01F 7/00*** | (2006.01) |
| ***B01F 7/06*** | (2006.01) |
| *B01F 7/02* | (2006.01) |

(52) U.S. Cl.

CPC ..... *B01F 7/00016* (2013.01); *B01F 7/06* (2013.01); *B01F 15/00006* (2013.01); *B01F 15/00922* (2013.01); *B01F 7/02* (2013.01); *B01F 2015/00084* (2013.01); *B01F 2015/00103* (2013.01); *Y10T 29/49719* (2015.01)

(58) Field of Classification Search

CPC ..... B01F 7/02; B01F 7/06; B01F 15/00922; B01F 2015/00084; Y10T 29/49719

USPC ..... 366/270, 331

See application file for complete search history.

(56) References Cited

U.S. PATENT DOCUMENTS

| | | | | |
|---|---|---|---|---|
| 2,137,328 | A * | 11/1938 | Bissell | 384/149 |
| 4,511,255 | A * | 4/1985 | Saucier | 366/138 |
| 5,040,899 | A * | 8/1991 | Koskinen | 366/281 |
| 5,078,506 | A * | 1/1992 | Tischer | 366/314 |
| 6,193,409 | B1 * | 2/2001 | Brunson et al. | 366/331 |

FOREIGN PATENT DOCUMENTS

CN 202146735 U 2/2012

OTHER PUBLICATIONS

Extended European Search Report mailed Sep. 30, 2013, from Application No. 13164161.5 (8 pages).

* cited by examiner

*Primary Examiner* — Tony G Soohoo

(74) *Attorney, Agent, or Firm* — Kilpatrick Townsend & Stockton LLP

(57) ABSTRACT

Disclosed is an agitator having a drive unit coupled by means of a coupling to a first end of a drive shaft, a propeller attached to a second end of the drive shaft, the drive unit being attached to a mounting flange adapted for fastening the agitator to a wall of a mixing vessel, the agitator further comprising a support housing having at least a tubular support frame with a first end and a second end, the first end of the tubular support frame being attached to the mounting flange, the second end of the tubular support frame being provided with a support bearing for supporting the second end of the drive shaft, wherein a shaft seal is arranged at the first end of the tubular support frame and sealing means is arranged in connection with the second end of both the drive shaft and the tubular support frame.

14 Claims, 7 Drawing Sheets

AGITATOR AND A METHOD OF REPLACING A SHAFT SEAL OF AN AGITATOR

CROSS-REFERENCE TO RELATED APPLICATIONS

This application claims priority to European Patent Application No. 13164161.5, filed Apr. 17, 2013, the disclosure of which is incorporated by reference herein.

TECHNICAL FIELD

The present invention relates to an agitator and a method of replacing a shaft seal of an agitator. The present invention relates to agitators used for agitating or mixing the contents of a mixing vessel, chest, tower or container, the propeller of the agitator located at a distance from the wall of the mixing vessel, chest, tower or container. Preferably, the agitator of the invention is a side mounted agitator, i.e. an agitator that is fastened to a side wall of the mixing vessel, chest, tower or container. The present invention relates especially to such an agitator and a method of replacing a shaft seal of an agitator that the mixing vessel, chest, tower or container need not be emptied, but the propeller of the mixer located inside the mixing vessel, chest, tower or container may be left on the shaft of the agitator for the time needed for the replacement operation without a risk of leakage of the liquid to be mixed or agitated.

BACKGROUND ART

So called side-mounted agitators are well known in the state of the art. Such agitators are formed of drive means, the propeller and the support means. The drive means comprise an electric drive motor, a reduction gear (with either gear wheels or belt and pulleys) and a propeller drive shaft. There are two options for arranging the electric drive motor and the reduction gear. In a first option the shaft of the drive motor is parallel with the propeller drive shaft, whereby also the shafts of the reduction gear are parallel with the propeller drive shaft. In a second option the electric drive motor is arranged at an angle to the axis of the propeller, normally at right angles to the axis.

An example of side-mounted agitators of the first option is disclosed in U.S. Pat. No. 5,040,899. The propeller drive shaft is normally formed of two parts, i.e. a first part extending out of the reduction gear and a second part actually driving the propeller. The parts are connected to one another by means of a coupling, which may be a flange coupling, a split muff coupling or a sleeve coupling. The support means ensure that the propeller may be taken deep into the mixing vessel without a risk of imbalance and vibrations of the long drive shaft. The support means comprises a support frame extending from a mounting flange, via which the agitator is attached to the wall of the mixing vessel, inside the mixing vessel towards the propeller. The support frame is, preferably but not necessarily, conical for facilitating the liquid flow in the vessel. At one end of the support frame, there is the support bearing, which is located as close to the propeller as practically possible for preventing the propeller shaft from bending and vibrating when in use. The support bearing used in this kind of prior art agitators is a ball or a roller bearing. For protecting the support bearing from the liquid, and especially from the solids in the liquid, to be agitated the space around the propeller shaft between the bearing and the propeller is provided with a shaft seal, which may be a single or double acting mechanical seal, a labyrinth seal or a packing box, just to name a few alternatives. The sealing is, naturally arranged to the extreme end of the support frame facing the propeller.

The agitator is fastened to the wall of a mixing vessel, chest, tower or container of its mounting flange such that the support frame extends through an opening in the wall of the mixing vessel deep inside the mixing vessel, and the drive means, for the most part thereof, remain outside the mixing vessel. Sometimes the mounting flange or the wall of the mixing vessel nearby is provided with two support rails on both sides of the drive means such that the drive means are supported on the rails, and may be pulled along the rails away from the mixing vessel. The US patent teaches that the propeller may be loosened from the end of its drive shaft after the mixing vessel has been emptied whereafter the sealing and the support bearing are accessible from inside the mixing vessel for the maintenance of the bearing and/or the sealing.

A problem relating to this kind of prior art agitators is that the sealing or the bearing at the end of the support frame cannot be replaced or serviced without emptying the mixing vessel. The emptying of the mixing vessel not only takes time but it also interrupts the production or, in the least, causes a risk of severe problems in the production.

Another prior art agitator has been discussed in U.S. Pat. No. 4,511,255. The patent discloses an agitator assembly including a drive shaft extending through a tubular housing. A slide coupling is connected between the outer end of the drive shaft and a drive motor. An impeller is secured to the other end of the drive shaft, which is supported on a bearing/seal member in the inner end of the shaft housing. The adjoining surfaces of the bearing/seal member and impeller base are normally engaged in rotary sealing relationship by springs but shift apart responsive to introduction of cleaning solution into the housing so that the cleaning solution is discharged into the tank at the base of the impeller after washing the seals to facilitate cleaning without manual disassembly or scrubbing. A rotary seal is arranged at the outer end of the shaft but the maintenance of the rotary seal has not been discussed.

A way to repair or to replace the shaft sealing without emptying the mixing vessel is disclosed in the CN utility model document representing the other option for arranging the electric drive motor and the reduction gear, i.e. to arrange the shaft of the electric drive motor at right angles to the propeller drive shaft, whereby the reduction gear is an angle gearbox. This kind of a construction is compact, as it does not require much space in radial direction outside the mixing vessel. However, the construction has some weaknesses, which will be discussed later on. The CN-U-202146735 document discusses an agitator fastened to the side wall of a vessel. The propeller shaft of the agitator extends deep into the vessel such that it is surrounded by a tubular support frame. The support frame is fastened at its first end to a mounting flange used for fastening the angle gearbox to the wall of the vessel. The propeller shaft extends through the angle gearbox and a mechanical seal is arranged in the neighood of the first end of the shaft such that it is easily accessible when needed, i.e. opposite to the second end of the shaft where the propeller is arranged. For repairing the mechanical seal the propeller shaft is provided at its second end close to the propeller with a plug and a sealing seat that cooperate with the end of the tubular support frame such that when the propeller shaft is pulled outwardly the plug and sealing seat prevent any leakage of the fluid from the vessel along the tubular support. At the second end of the propeller shaft there is also locking means for preventing the rotation of the shaft during maintenance for facilitating the maintenance of the shaft sealing. The locking means are supposed to function such that by pulling and simultaneously rotating the shaft the cogs and grooves of the locking means find one another and lock the shaft immobile in circumferential direction.

The agitator disclosed in the Chinese document has, however, a number of weaknesses or problems in both structural and functional sense. Firstly, at least the document does not explain how the shaft is supported during the repair or replacement of the shaft sealing. The propeller shaft of the agitator discussed in the CN document is driven, and supported by means of a drive member attached to the first end of the shaft, whereby the drive member has to be removed prior to the repair or replacement of the shaft seal at the very same end of the shaft. The document does not give any suggestion to support the shaft somehow, whereby there is a risk that the support bearing at the second end of the shaft gets damaged due to the slightly swinging shaft therein. Also, though it has been discussed that the plug and the sealing seat prevent the leakage when the shaft is pulled outwardly, on the one, it has not been taught how the shaft is kept in its pulled position during the maintenance of the shaft seal, and on the other hand, the slight swinging of the shaft causes minor deflections in the directions of the sealing surfaces, whereby there is a clear risk the seal starts leaking. As to the locking of the shaft immobile in circumferential direction by using locking means situated in the mixing vessel in communication with the liquid being mixed, practice has shown that the user cannot ever be sure that the locking works properly. Very often the fluid in the mixing vessel includes solids or some substances that tend to collect in the grooves of the locking means, whereby the locking cannot be secure. And finally the angle gear itself due to its constructional limitations to a certain reduction range cannot be applied to the full range of electric motors and agitators needed in different mixing applications. Therefore the angle gear should be combined with another reduction gear, which raises the costs of the drive means significantly.

BRIEF SUMMARY OF THE INVENTION

An object of the present invention is to offer a solution to at least some of the above discussed problem.

Another object of the present invention is to offer a method of replacing or servicing the sealing of the propeller shaft such that the shaft is properly supported during the maintenance.

Yet another object of the present invention is to offer a method of replacing or servicing the sealing of the propeller shaft such that ordinary standard gearboxes and electric motors may be used.

A further object of the present invention is to offer a method of replacing or servicing the sealing of the propeller shaft such that the locking of the drive shaft may be performed in a secure and reliable manner.

A still further object of the present invention is to offer a method of replacing or servicing the sealing of the propeller shaft without a risk of leakage of the liquid from the mixing vessel.

At least one object of the invention is met by an agitator comprising a drive unit coupled by means of a coupling to a first end of a second drive shaft, a propeller attached to a second end of the second drive shaft, the drive unit being attached to a mounting flange adapted for fastening the agitator to a wall of a mixing vessel, the agitator further comprising a support housing having at least a tubular support frame with a first end and a second end, the first end of the tubular support frame being attached to the mounting flange, the second end of the tubular support frame being provided with a support bearing for supporting the second end of the second drive shaft, the support bearing being a slide bearing, a shaft seal arranged at the first end of the tubular support frame, the shaft seal being provided with means for locking the shaft seal on the second drive shaft, and the shaft seal being fastened either to the mounting flange or to the first end of the tubular support frame, sealing means arranged in connection with the second end of both the second drive shaft and the tubular support frame, the sealing means comprising a sealing member and a counter surface, and an intermediate frame between the drive unit and the mounting flange comprising an opening or window, wherein a carrier is provided at one of the mounting flange and the first end of the tubular support frame adapted for locking the second drive shaft immobile in both axial and circumferential directions for the maintenance of the shaft seal.

At least one object of the invention is met by a method of maintaining a shaft seal of an agitator as recited in any one of the claims 1-7, the method comprising the steps of loosening the axial locking of the shaft seal, loosening either the drive unit from the intermediate frame or the intermediate frame from the mounting flange, pulling either the drive unit away from the intermediate frame or the intermediate frame away from the mounting flange until the sealing surfaces of the sealing means are pressed to one another, loosening the shaft seal either from the first end of the support housing or from the mounting flange, pulling the shaft seal away from either the first end of the support housing or the mounting flange, making the second drive shaft immobile in both axial and circumferential directions by locking the second drive shaft in place by means of a carrier, detaching either the drive unit from the intermediate frame or the drive unit and the intermediate frame from the mounting flange, performing required maintenance actions, and assembling the agitator in opposite sequence.

Other characterizing features typical of the agitator and the method in accordance with the present invention become evident from the accompanying dependent patent claims.

Advantages of the agitator and the method in accordance with the invention are, for example, the following:

- No need for emptying the mixing vessel for the maintenance of the shaft sealing,
- Quick maintenance,
- No risk of leakage during maintenance, and
- Possibility to use standard gearboxes and electric motors.

BRIEF DESCRIPTION OF DRAWING

The agitator and the method of replacing a shaft seal of an agitator in accordance with the present invention is described more in detail with reference to the accompanying drawings, in which FIG. 13 illustrates an optional construction for the agitator of FIG. 7, and.

DETAILED DESCRIPTION OF DRAWINGS

Figure 1:
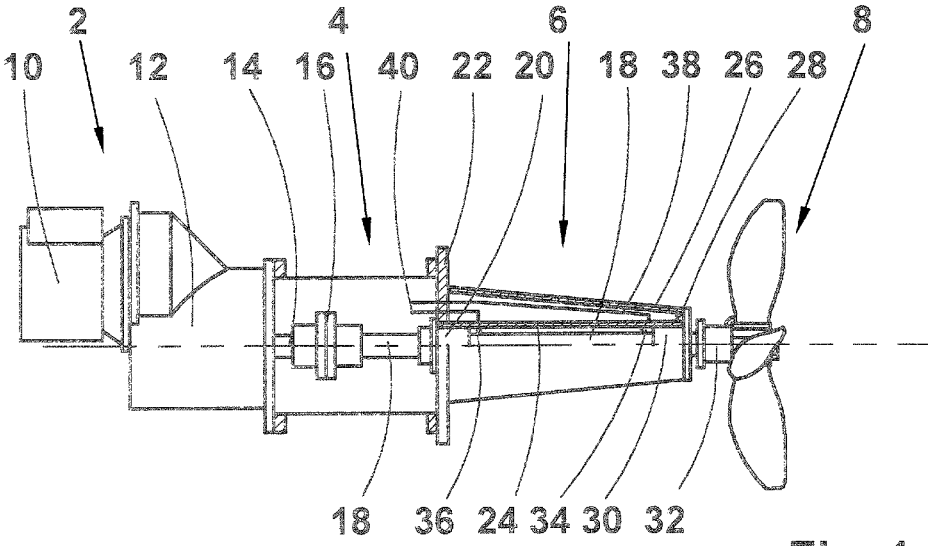
FIG. 1 illustrates schematically an agitator in accordance with a first preferred embodiment of the present invention in its normal operating condition.

FIG. 1 discloses an agitator in accordance with a first preferred embodiment of the present invention in its normal operating condition. The agitator is formed of a drive unit 2, an intermediate frame 4, a support frame 6 and a propeller 8. The drive unit 2 comprises an electric drive motor 10, a reduction gear 12, a first drive shaft 14 (when a certain type of reduction gear is used), and a first half of a coupling 16 (when a certain type of coupling is used). However, it has to be understood that the coupling 16 may be any prior art coupling including but not limited to sleeve coupling, split muff coupling and sleeve coupling, whereby the coupling may be considered to belong entirely to the drive unit 2 or to the second drive shaft 18, too. There are two basic types of reduction gears available for the present application. The first type, illustrated in the Figures, has a first drive shaft extending from the gearbox such that a flange of split muff coupling may be used. The second type has just a shaft sleeve extending from the gearbox, whereby the coupling of the propeller drive shaft takes place by just pushing the propeller shaft into the shaft sleeve and locking it therein for preventing axial movement of the propeller drive shaft. Naturally, it is also possible that the end of the propeller drive shaft is provided with a shaft sleeve, whereby, when connecting to the reduction, it is pushed on the short shaft extending out of the reduction gearbox. The reduction gear 12 may also be replaced with an electric motor and drive belt/s and pulleys. The intermediate frame 4 merely surrounds the coupling 16, the second drive shaft 18 (partially) and at least partially the shaft seal 20. Here the shaft seal is a mechanical seal, as it is the most common type of sealing used in connection with agitators. The mechanical seal 20 has a rotatable part locked on the second drive shaft 18 by means of, for instance, screws, and a stationary part fastened either to the first end of the tubular support frame 24 or to the mounting flange 22. The intermediate frame 4 need not be a closed housing, but it may have one or more service or other windows for accessing the coupling 16 and/or the mechanical seal 20, for instance. The intermediate frame 4 connects the drive unit 2 with the support frame 6 such that the intermediate frame 4 is at its first end fastened to the drive unit 2 and at its opposite, second end to a mounting flange 22 arranged at a first end of the support frame 6. The mounting flange 22 is adapted for fastening the agitator to the wall of the mixing vessel. The mounting flange 22 has an opening for the second drive shaft 18, the mechanical seal 20 surrounding the shaft 18 and the support frame 6. The mechanical seal is installed within the support frame and attached either to the first end of the support frame 6 or to the mounting flange 22.

The support frame 6 comprises, in this embodiment, in addition to the tubular support frame 24, an outer housing 26 fastened at its first end to the mounting flange 22. The outer housing 26 extends from the mounting flange 22, and, in this embodiment of the present invention, tapers towards the propeller 8 for facilitating the fluid circulation in the mixing vessel. The outer housing 26 terminates at its second end, preferably, to an end flange 28 close to the propeller 8. However, as shown in FIGS. 7-11 and 13 the existence of the outer housing is not a necessity but an agitator may be built with a tubular support frame only, The end flange 28 may be replaced with any means for joining the second ends of the outer housing 26 and the tubular support frame 24. In other words, a mere weld seam attaching the tubular support frame and the outer housing to one another may be considered to form an end flange 28. The tubular support frame 24 is, preferably, but not necessarily, a cylindrical tube that houses at its first end the mechanical seal 20 and at its second end the support bearing 30.

The support bearing 30 is, in accordance with the present invention, a slide bearing having bearing surfaces of Teflon, bronze or any other appropriate material in view of the medium to be mixed or agitated. In other words, the outer and non rotary rim of the slide bearing 30 is; for instance, shrink fitted inside the tubular support frame 24, and the inner, rotary rim fitted on the second drive shaft 18. Now that the slide bearing 30 is manufactured of material that withstands both the physical and chemical corrosion the fluid to be mixed or agitated subjects thereto, the bearing 30 is trouble-free and service-free. The support bearing 30 supports, naturally with the aid of the tubular support frame and the outer housing the second drive shaft 18 such that the bending and vibration tendency of the second drive shaft 18 due to the weight, rotation and possible imbalance of the propeller 8 is minimized. The second drive shaft 18 and the tubular support frame 24 are, additionally, at their second ends provided with sealing means 32 between the propeller 8 and the support bearing 30. Additionally, FIG. 1 illustrates two service sealings 34 and 36 arranged inside the tubular support frame 24 and adjacent the support bearing 30 and the sealing 20, and lines 38 and 40 extending from between the tubular support frame 24 and the outer housing 26 through an opening in the mounting flange 22 to a source of pressure medium for leading a pressure medium to the service sealings. The purpose and exemplary structure of the sealing means and the service sealings are explained in more detail in connection with FIG. 2.

Figure 2:
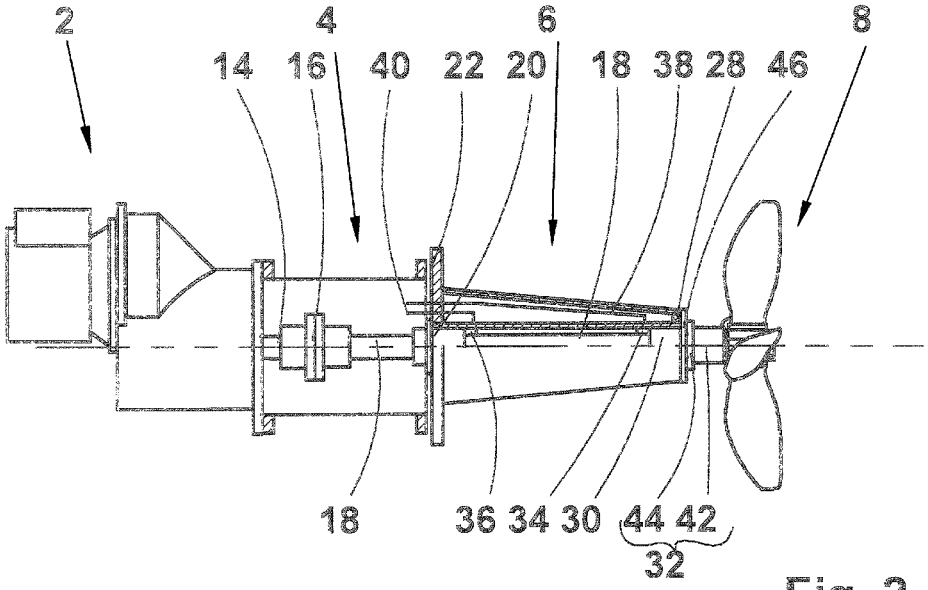
FIG. 2 illustrates the agitator of FIG. 1 in a situation where the sealing has started to leak and the drive of the agitator is moved outwards.

FIG. 2 illustrates the agitator after a leak of the mechanical seal has been detected, i.e. the liquid to be mixed or agitated is leaking via an opening in the intermediate frame 4. In such a case the first thing to do is to detach the locking between the rotary part of the mechanical seal 20 and the second drive shaft 18 via an opening or window in the intermediate frame 4. Next there are two options. As a first option, the fastening of the intermediate frame 4 to the mounting flange 22 is loosened, and the intermediate frame 4 together with the drive unit 2 is pulled away from the mounting flange 22, i.e. away from the wall of the mixing vessel. Thus, the intermediate frame 4 is either supported on rails as discussed in connection with the prior art, on guide pins arranged on the mounting flange 22 so that the intermediate frame moves only in the direction of the propeller axis, or on some other appropriate manner. As a second option, the fastening of the intermediate frame 4 to the drive unit 2 is loosened, and the drive unit 2 is pulled away from the intermediate frame 4. Here, the drive unit 2 is either supported on rails, on guide pins arranged on the face of the intermediate frame 4 so that the drive unit moves only in the direction of the propeller axis, or on some other appropriate manner. In practice, in both options, the pulling of the drive unit 2 away from the mixing vessel means, as the coupling 16 (and its axial locking on the first and second drive shafts 14 and 18, irrespective of the type of the coupling) keeps the first and the second drive shafts together, that the propeller 8 is pulled towards the support frame 6 without moving the mechanical seal 20. The use of a slide bearing 30 at the second end of the support frame 6 allows the axial movement of the second shaft 18 unlike the ball or roller bearings of prior art agitators. The propeller 8 moves towards the wall of the mixing vessel, pulled by the second drive shaft 18 until the sealing means 32, i.e. a sleeve 42 on the second drive shaft 18 and a, preferably but not necessarily radially, outwardly extending sealing member 44 on the sleeve, are pressed against the end flange 28 of the support housing 6 or the second end of the tubular support frame 24 and especially the counter surface 46 thereon. The preferably radial outwardly extending sealing member 44 and the counter surface 46 are preferably made of Teflon or some other appropriate material in view of the liquid to be mixed or agitated. The sealing means 32 may have radial sealing surfaces as explained above. However, it is also possible to arrange the sealing surfaces more or less conical, which may somewhat improve the sealing capability. The pressure by which the sealing surfaces are pressed against one another may be adjusted by the means used for pulling the drive unit away from the mixing vessel. For instance the fastening flange of the intermediate frame 4 or that of the drive unit 2 may be provided with a few push screws the heads of which abut the face of the opposing surface on the mounting flange or on the intermediate frame 4. When screwing the push screws in their heads push the drive unit 2 and the intermediate frame 4 or the drive unit 2 only to the left (in Figures) away from their counter surface until a desired pressure is created between the sealing surfaces near the propeller 8.

After the drive unit 2 is moved as far away from the mounting flange 22 as the sealing means 32 allows the service sealings 34 and 36 are activated. In accordance with a preferred alternative pressure medium, like for instance air, is allowed to enter lines 38 and 40 from a source of pressure medium (not shown) in order to pressurize the service sealings 34 and 36. When the service sealings 34 and 36 are pressurized, for instance inflated, they are pressed against the surface of the second drive shaft 18 stopping the possible minor leakage through the sealing means 32 into the interior of the inner housing 28.

As to the service sealings, it should be understood that they are not necessary, but the agitator may be built without such, too. However, they or at least one of them is a handy safety feature of an agitator. Another preferable, but by no means necessary, equipment of an agitator is a leakage detection line (not shown), which may be arranged to lead from the bottom of the tubular support frame between the mechanical seal 20 and the support bearing 30 via the mounting flange 22 and the intermediate housing 4 to the atmosphere. Such a leakage detection line may be utilized in both during the normal running or, especially, during the maintenance of the mechanical seal. In the latter case, the leakage detection line monitors the reliability of the sealing means 32 as well as the service sealing/s 34 and/or 36, if such are used. Thus the detection line may have its origin, when both service sealing are used, on either side of the service sealing 36 adjacent to the mechanical seal 20.

Figure 3:
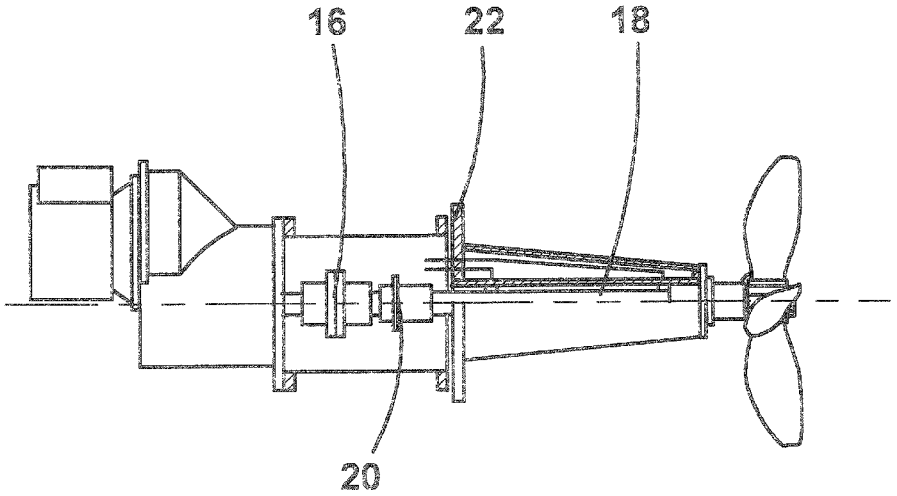
FIG. 3 illustrates the agitator of FIG. 1 in a situation where the shaft seal is moved outwards.

FIG. 3 illustrates a maintenance phase when the mechanical seal 20 is detached from the mounting flange 22, and moved along the second drive shaft 18 towards the coupling 16.

Figure 4:
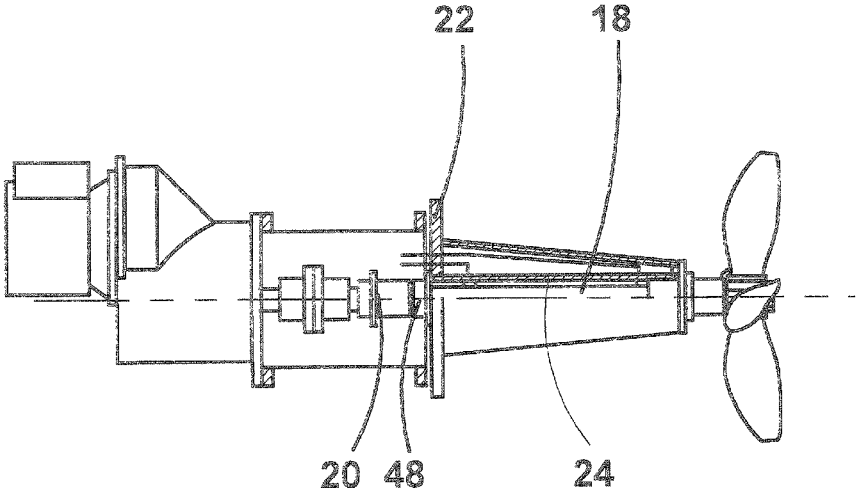
FIG. 4 illustrates the agitator of FIG. 1 in a situation where a specific holder has been installed in place of the shaft seal.
Figure 14:
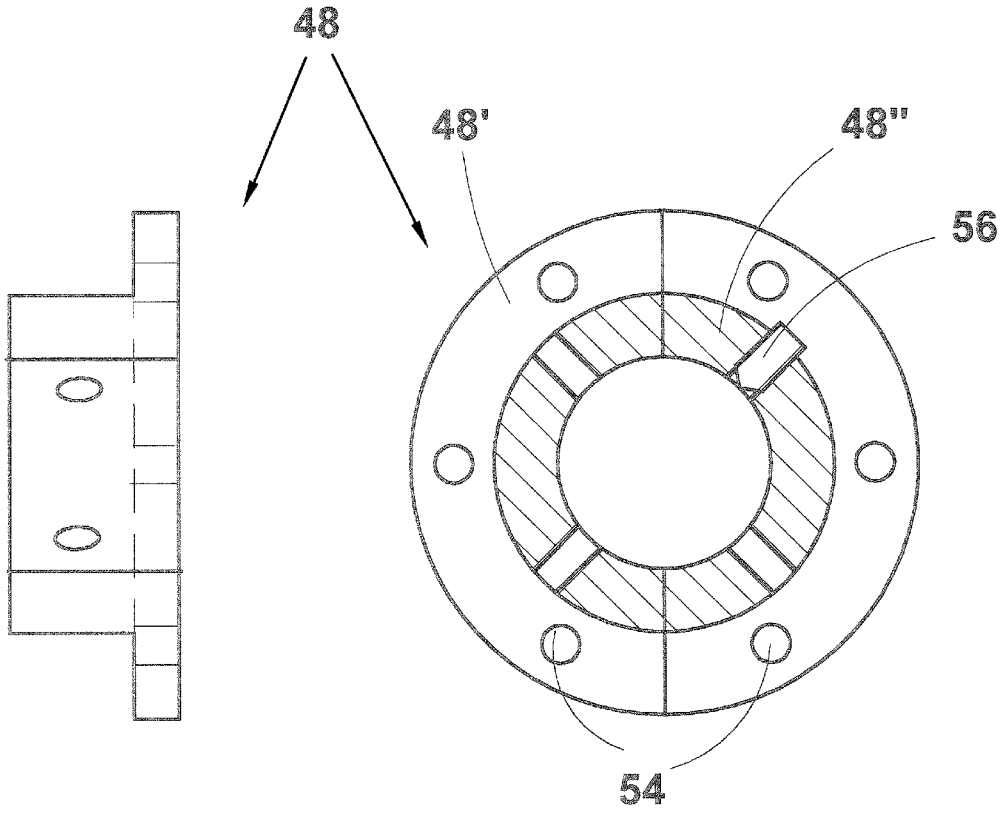
FIG. 14 illustrates a temporary carrier used for supporting the shaft of the agitator during the maintenance of the shaft seal.

FIG. 4 illustrates a maintenance phase when, in place of the mechanical seal, a temporary carrier 48 is positioned. The temporary carrier 48, discussed in more detail in FIG. 14, is made, in this embodiment of the present invention of two parts, i.e. the temporary carrier is radially split into two parts such that the parts may be fastened together round the second drive shaft 18, whereafter the temporary carrier 48 is fastened to the mounting flange 22 in the manner similar to the mechanical seal. Finally the temporary carrier 48 is locked to the second drive shaft 18 such that the second drive shaft 18 is immobile, both in axial and circumferential directions. Naturally, it is also possible to construct the temporary carrier 48 such that by just bolting it in place of the mechanical seal it locks the second drive shaft 18 in place in the desired manner. However, as an alternative to the above discussed structure of the temporary carrier, the carrier may also be arranged permanently in the agitator. An option is to extend the first end of the tubular support frame 24 at a distance outside the mounting flange 22 inside the intermediate frame 4 and provide the first end of the tubular support frame 24 with means, i.e. the carrier for locking the second drive shaft in place when the mechanical seal 20 is removed from within the tubular support frame 24. Naturally the integrated carrier may also be a part of the mounting flange 22, too.

Figure 5:
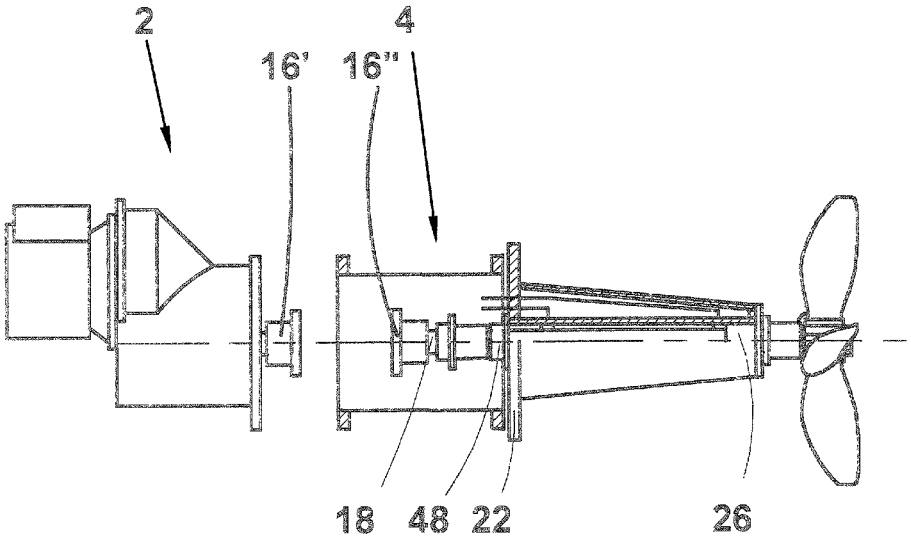
FIG. 5 illustrates the agitator of FIG. 1 in a situation where the shaft coupling is opened and the drive is dismantled.

FIG. 5 illustrates a maintenance phase when, firstly, the axial halves 16' and 16" of the coupling 16, when it is a question of a splittable coupling, like a flange coupling, are loosened from one other, and secondly, the drive unit 2 is loosened from the intermediate frame 4 entirely. Naturally another option would be to detach the drive unit-intermediate housing unity from the mounting flange 22. Now the second drive shaft 18 is supported by the slide bearing 30 and the temporary or separate carrier 48. If only the drive unit 2 is moved, it may be either taken entirely apart from the intermediate frame 4 or moved to the side thereof by means of appropriate hinge means.

Figure 6:
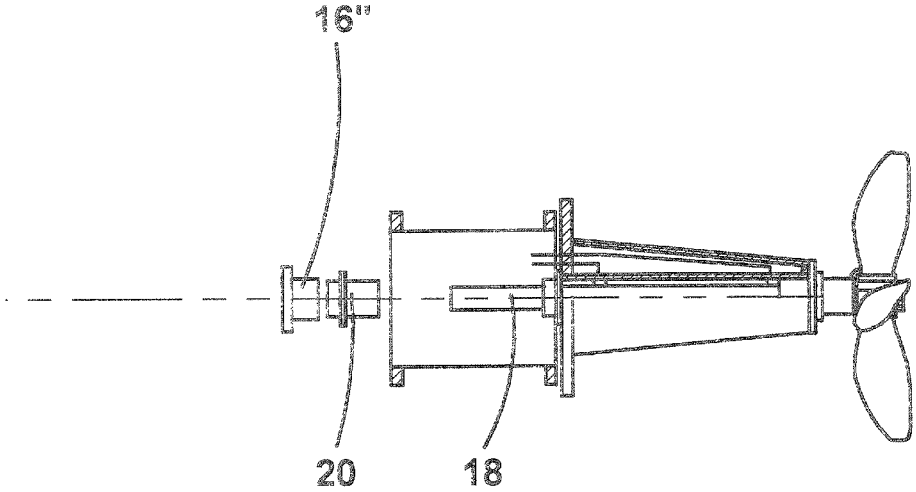
FIG. 6 illustrates the agitator of FIG. 1 in a situation where a half of the coupling and the shaft seal are removed from the shaft.

FIG. 6 illustrates the final phase of the dismantling operation, i.e. a phase when the second axial half 16" of the coupling is first unlocked from the second drive shaft 18 (normally locked immobile in both axial and circumferential directions) and then the second half 16" of the coupling and the mechanical seal 20 are pulled away from the second drive shaft 18.

Figure 7:
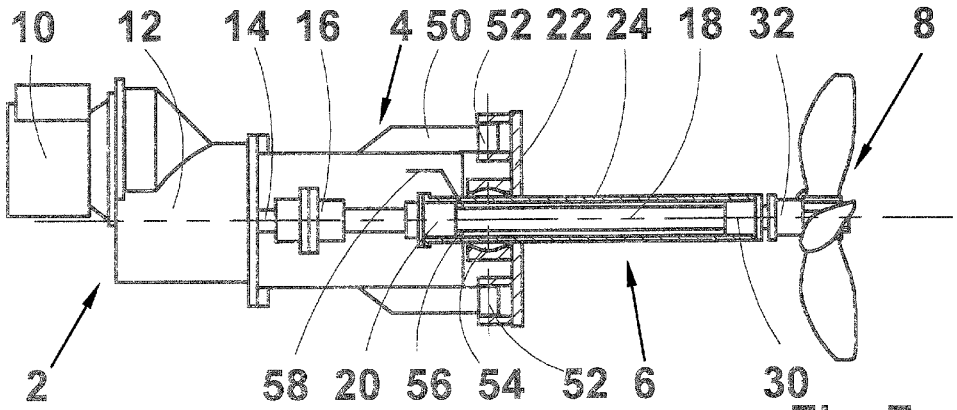
FIG. 7 illustrates schematically an agitator in accordance with a second preferred embodiment of the present invention in its normal operating condition.

FIG. 7 illustrates an agitator in accordance with a second preferred embodiment of the present invention. A specific feature of the agitator of FIG. 7 is that it is a swivelling one, i.e. it is able to turn round a pivot such that the propeller and its shaft may swivel within a certain angular range, preferably, but not necessarily in a horizontal plane) in the mixing vessel. Since most of the components of the agitator are the same as in the first preferred embodiment discussed in FIGS. 1-6, the same reference numbers are used for such components.

In other words, FIG. 7 discloses an agitator (a swivelling one) in accordance with a second preferred embodiment of the present invention in its normal operating condition. The agitator is formed of a drive unit 2, an intermediate frame 4, a support frame 6 and a propeller 8. The support frame 6 of the agitator it, in this embodiment of the present invention a tubular support frame 24. The drive unit 2 comprises an electric drive motor 10, a reduction gear 12, a first drive shaft 14, and a first half of a coupling 16. The discussion relating to the reduction gear in connection with the first embodiment of the present invention applies to the second embodiment, too. As to the coupling it may be any prior art coupling used for coupling two shaft together. Preferable types of couplings include, without limitation, a flange coupling, a split muff coupling and a sleeve coupling. The electric drive motor 2 and the reduction gear 4 may be replaced with an electric motor and drive belt/s and pulleys. The intermediate frame 4 merely surrounds the coupling 16, the second drive shaft 18 (partially) and the mechanical seal 20. The intermediate frame 4 may have one or more windows/openings for accessing the coupling and/or the mechanical seal. The intermediate frame 4 is coupled to a mounting flange 22 by means two arms 50 and two pivots 52 one above the propeller shaft 18 and the other therebelow. The mounting flange 22 has an opening for the second drive shaft 18 and its tubular support frame 24. The mounting flange 22 is further provided with a ball-type support bearing 54 between the pivots 52 such that the tubular support frame 24 extends from the nearhood of the propeller 8 through the ball-type support bearing 54 outside the mixing vessel. The tubular support frame 24 is attached to the mounting flange by means of the ball-type support bearing 54. Naturally both the pivots 52 and the support bearing 54 are located on the face of the mounting flange 22 facing the drive unit 2 outside the mixing vessel. Also, the pivots 52 and the ball-type support bearing 54 are aligned such that the entire agitator may swivel in horizontal plane within a certain angular range round the pivotal axis. Thus, the intermediate frame 4 connects the drive unit 2 with the support frame 6 such that the intermediate frame 4 is at its first end fastened to the drive unit 2 and at its second opposite end to a mounting flange 22 arranged to carry the tubular support frame 18 at its first end. The mechanical seal 20 is attached to the first end of the tubular support frame 24, which is preferably but not necessarily provided with a flange. The mechanical seal 20 has a rotatable part locked on the second drive shaft 18 by means of, for instance, screws, and a stationary part fastened either to the first end of the tubular support frame 24 or to the mounting flange 22. At its opposite, i.e. at its second end the tubular support frame 24 houses the support bearing 30.

The support bearing 30 is, in accordance with the present invention, a slide bearing having bearing surfaces of Teflon, bronze or any other appropriate material in view of the medium to be mixed or agitated. In other words, the outer and non-rotary rim of the slide bearing 30 is, for instance, shrink fitted inside the tubular support frame 24, and the inner, rotary rim fitted on the second drive shaft 18. Now that the slide bearing 30 is manufactured of material that withstands both the physical and chemical corrosion the fluid to be mixed or agitated subjects thereto, the bearing 30 is trouble-free and service-free. The support bearing 30 supports the second drive shaft 18 such that the bending and vibration tendency of the second drive shaft 18 due to the weight, rotation and possible imbalance of the propeller 8 is minimized. The second drive shaft 18 is, additionally, provided with sealing means 32 between the propeller 8 and the support bearing 30. Additionally, FIG. 7 illustrates, as a preferable but not necessary equipment of a service sealing 56 arranged inside the tubular support frame 24 adjacent the mechanical seal 20, in fact, between the mechanical seal 20 and the support bearing 30 and line 58 for leading a pressure medium to the service sealing 56. The purpose and exemplary structure of the sealing means 32 as well as its operation and the service sealing/s are explained in more detail in connection with FIG. 2. If the leak detection line discussed in the first embodiment is desired in this embodiment, too, it should have its origin between the service sealing 56 and the mechanical seal 20 such that, after pressurizing the service sealing and before removing the mechanical seal it may be ensured that there is no leak by-passing the service sealing 56.

Figure 8:
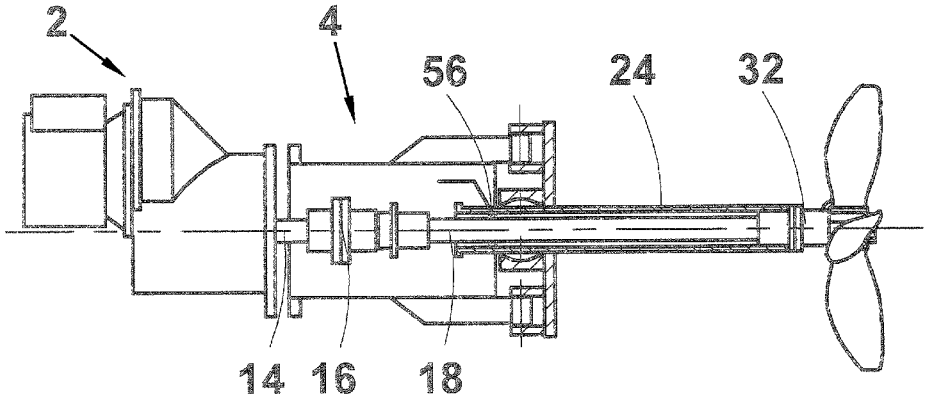
FIG. 8 illustrates the agitator of FIG. 7 in a situation where a leak is detected and the shaft seal is moved outwards.

FIG. 8 illustrates the agitator of FIG. 7 in a situation where a leak is detected and measures to start the maintenance of the sealing are initiated. First, the rotating part of the mechanical seal 20 is loosened from the second drive shaft 18. Next, the drive unit 2 is detached from the intermediate frame 4 and the drive unit 2 together with the first and second drive shafts 14 and 18 are pulled outwardly, for instance by push screws, such that the sealing means 32 at the second end of the second drive shaft 18 are pressed to one another preventing the leak at the second end of the tubular support frame 24. Next the service sealing 56 is pressurized such that it takes care of the possible minor leakage still occurring at the second end of the tubular support frame 24. And finally the mechanical seal 20 is loosened from the first end of the tubular support frame 24 and moved outwards towards the coupling 16.

Figure 9:
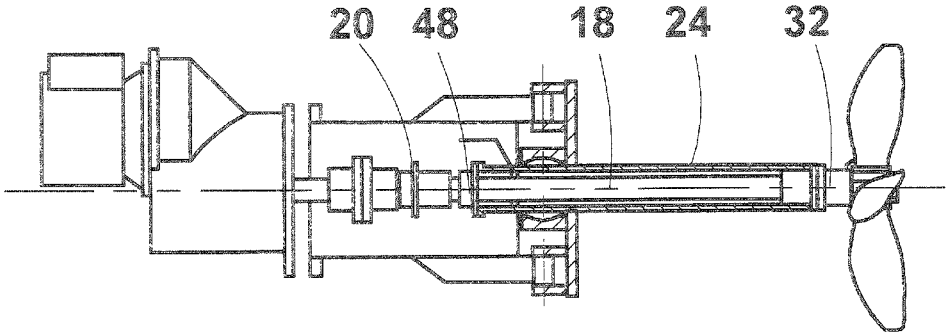
FIG. 9 illustrates the agitator of FIG. 7 in a situation where a specific holder has been installed in place of the shaft seal.

FIG. 9 illustrates the agitator of FIG. 7 in a situation where a separate carrier 48 is activated, or rather, installed in place of the mechanical seal 20 to the first end of the tubular support frame 24. The carrier 48 supports the second drive shaft 18 centrally in place in both axial, radial and circumferential directions within the tubular support frame 24 and keeps the sealing means 32 at the second end of the tubular support frame 24 pressed to one another. The carrier 48 is, for instance, a splittable two-part member that may be installed on the second drive shaft 18, and fastened to the same screw holes with the mechanical seal 20. As an alternative to the above discussed, the carrier may also be an integral part of the agitator. In other words, either the first and of the tubular support frame 24 or the mounting flange 22 may be provided with a carrier adapted for locking the second drive shaft 18 immobile in both axial and circumferential directions when maintaining the mechanical seal 20 such that after the mechanical seal 20 is removed from within the tubular support frame 24, the carrier means are activated such that the second drive shaft is kept in place.

Figure 10:
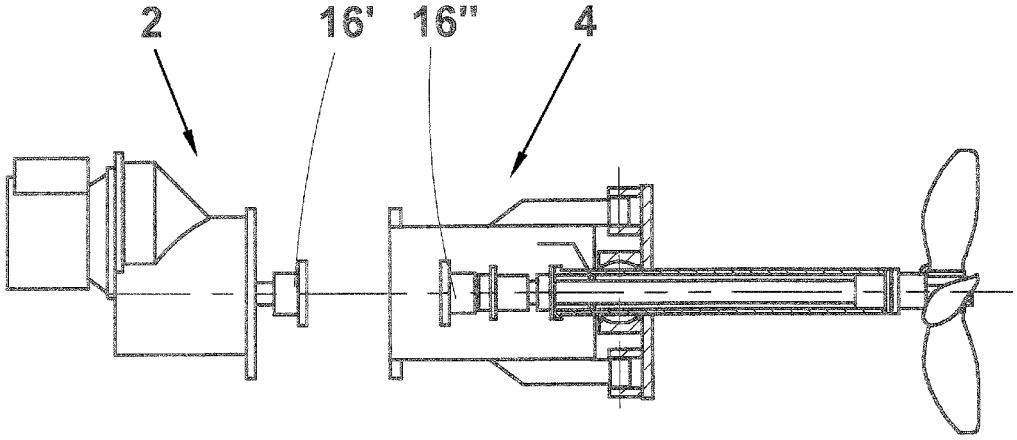
FIG. 10 illustrates the agitator of FIG. 7 in a situation where the shaft coupling is opened and the drive is dismantled.

FIG. 10 illustrates the agitator of FIG. 7 in a situation where the shaft coupling 16 is opened and the drive unit 2 is dismantled entirely. In accordance with a preferred option, the drive unit 2 has been arranged to be turned to the side of the intermediate frame 4 by means of appropriate hinges (not shown).

Figure 11:
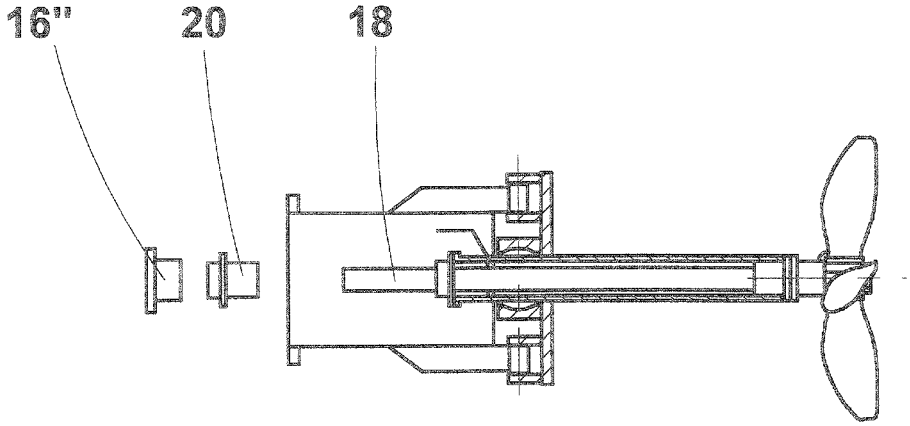
FIG. 11 illustrates the agitator of FIG. 7 in a situation where a half of the coupling and the shaft seal are removed from the shaft.

FIG. 11 illustrates the agitator of FIG. 7 in a situation where the remaining half 16" of the coupling is loosened from the second drive shaft 18 and together with the mechanical seal 20 removed from the shaft 18.

Figure 12:
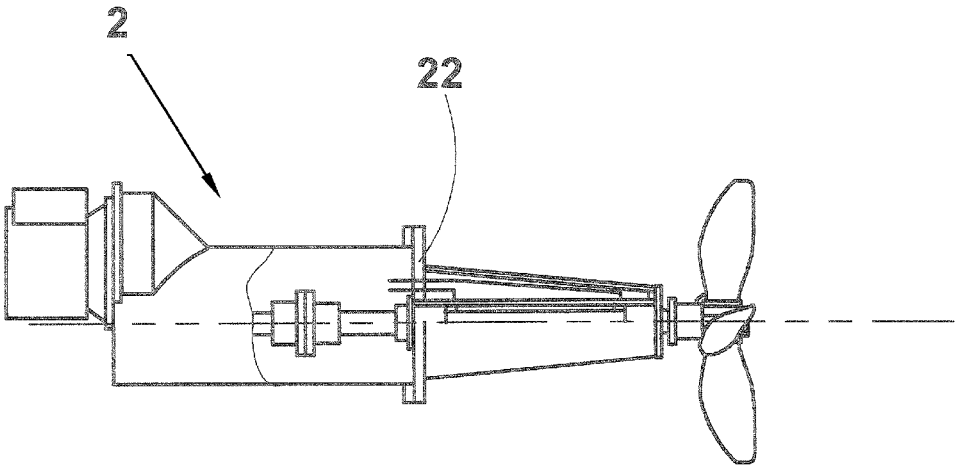
FIG. 12 illustrates an optional construction for the agitator of FIG. 1.

FIG. 12 illustrates as an optional construction for an agitator of FIG. 1 an agitator where the intermediate frame of FIG. 1 is combined to the housing of the drive unit 2 such that the drive unit 2 is directly attached to the mounting flange 22.

Figure 13:
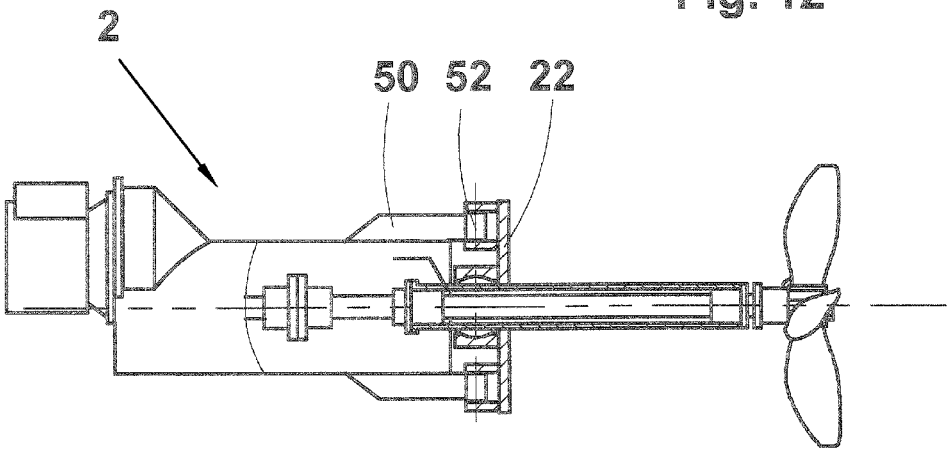

FIG. 13 illustrates as an optional construction for an agitator of FIG. 7 an agitator where the intermediate frame of FIG. 7 is combined to the housing of the drive unit 2 such that the drive unit 2 is directly attached by means of a pair of arms 50 and a pair of pivots 52 to the mounting flange 22.

FIG. 14 illustrates a temporary carrier used for supporting the shaft of the agitator during the maintenance of the mechanical seal. The temporary carrier 48 is made of two parts, i.e. the temporary carrier is radially split into two parts 48' and 48" such that the parts may be fastened to the same mounting flange where the mechanical seal is normally fastened. Preferably, but not necessarily, the fastening takes place with the same bolts/screws as the mechanical seal. In other words, the fastening holes 54 in the carrier have the same angular positioning and dimensioning as the corresponding holes in the mechanical seal. Finally the temporary carrier 48 is locked to the second drive shaft by using one or more radially threadable stop screws 56 such that the second drive shaft is immobile, both in axial and circumferential directions. Naturally, it is also possible to construct the temporary carrier such that by just bolting it in place of the mechanical seal it locks the second drive shaft in place in the desired manner. In such a case the carrier is at its inner circumference facing the shaft provided with appropriate locking means like ridges or pin like protrusions.

At this stage it has to be understood that the shaft seal does not necessarily have to be a mechanical seal, but sealings including, but not limited to, a packing box type sealing, a labyrinth seal, a cartridge seal or a lip seal may be used too. A feature common to all sealing types is that the sealing cover or sealing housing is removed for the maintenance of the sealing so that it may be replaced with the temporary carrier.

In both embodiments of the present invention, after the disassembly of the agitator required repair operations may be performed to the shaft seal. As another option the shaft seal may be replaced entirely in connection with the assembly of the agitator taking place in the order opposite to the above described.

As can be seen from the above description a novel method of repairing a shaft seal of an agitator has been developed. While the invention has been herein described by way of examples in connection with what are at present considered to be the most preferred embodiments, it is to be understood that the invention is not limited to the disclosed embodiments, but is intended to cover various combinations and/or modifications of its features and other applications within the scope of the invention as defined in the appended claims.

The invention claimed is:

1. An agitator comprising a) a drive unit (2) coupled by means of a coupling (16) to a first end of a second drive shaft (18), b) a propeller (8) attached to a second end of the second drive shaft (18), c) the drive unit (2) being attached to a mounting flange (22) adapted for fastening the agitator to a wall of a mixing vessel, d) the agitator further comprising a support housing (6) having at least a tubular support frame (24) with a first end and a second end, e) the first end of the tubular support frame (24) being attached to the mounting flange (22), f) the second end of the tubular support frame (24) being provided with a support bearing (30) for supporting the second end of the second drive shaft (18), the support bearing (30) being a slide bearing, g) a shaft seal (20) arranged at the first end of the tubular support frame (24), the shaft seal (20) being provided with means for locking the shaft seal (20) on the second drive shaft, and the shaft seal (20) being fastened either to the mounting flange (22) or to the first end of the tubular support frame (24), h) sealing means (32) arranged in connection with the second end of both the second drive shaft (18) and the tubular support frame (24), the sealing means comprising a sealing member (44) and a counter surface (46), and i) an intermediate frame (4) between the drive unit (2) and the mounting flange (22) comprising an opening or window, wherein a carrier is provided at one of the mounting flange (22) and the first end of the tubular support frame (24) adapted for locking the second drive shaft (18) immobile in both axial and circumferential directions for the maintenance of the shaft seal (20).

2. The agitator as recited in claim 1, wherein one of the mounting flange (22) and the first end of the tubular support frame (24) is provided with means for receiving a separate carrier (48) adapted for locking the second drive shaft (18) immobile in both axial and circumferential directions when maintaining the shaft seal (20).

3. The agitator as recited in claim 2, wherein the receiving means are the means used for fastening the shaft seal (20) either to the mounting flange (22) or to the first end of the tubular support frame (24).

4. The agitator as recited in claim 2, wherein the carrier (48) is a splittable member adapted to be installed on the second drive shaft (18).

5. The agitator as recited in claim 1, wherein the shaft seal (20) is a mechanical seal having a rotatable part and a stationary part, the rotatable part being locked on the second drive shaft (18) and the stationary part being fastened to one of the first end of the tubular support frame (24) and the mounting flange (22).

6. The agitator as recited in claim 1, wherein the tubular support frame (24) houses at least one service sealing (34, 36; 56).

7. The agitator as recited in claim 1, wherein the intermediate frame (4) is a separate part between the drive unit (2) and the mounting flange (22) or it is combined to the housing of the drive unit (2).

8. A method of maintaining a shaft seal of the agitator as recited in claim 1, the method comprising the steps of a) Loosening the axial locking of the shaft seal (20), b) Loosening either the drive unit (2) from the intermediate frame (4) or the intermediate frame (4) from the mounting flange (22), c) Pulling either the drive unit (2) away from the intermediate frame (4) or the intermediate frame (4) away from the mounting flange (22) until the sealing surfaces of the sealing means (32) are pressed to one another, d) Loosening the shaft seal (20) either from the first end of the support housing (6) or from the mounting flange (22), e) Pulling the shaft seal (20) away from either the first end of the support housing (6) or the mounting flange (22), f) Making the second drive shaft (18) immobile in both axial and circumferential directions by locking the second drive shaft (18) in place by means of a carrier (48), g) Detaching either the drive unit (2) from the intermediate frame (4) or the drive unit (2) and the intermediate frame (4) from the mounting flange (22), h) Performing required maintenance actions, and i) Assembling the agitator in opposite sequence.

9. The method as recited in claim 8, wherein step (h) comprises removing the shaft seal (20) from the second drive shaft (18) for the maintenance or for replacement with a new shaft seal.

10. The method as recited in claim 8, further comprising after step (c), activating a service sealing (34, 36; 56).

11. The method as recited in claim 8, wherein step (f) comprises activating a carrier arranged in communication with either the first end of the support housing (6) or the mounting flange (22) to lock the second drive shaft (18) in place.

12. The method as recited in claim 8, wherein step (f) comprises installing a separate carrier (48) on the second drive shaft (18) between the shaft seal (20) and either the first end of the support housing (6) or the mounting flange (22) and fastening the carrier (48) either to the first end of the support housing (6) or to the mounting flange (22).

13. The method as recited in claim 8, further comprising before step (g), opening the coupling (16) connecting the second drive shaft (18) to the drive means (2).

14. The method as recited in claim 8, further comprising before step (h), loosening the locking of the second half (16") of the coupling (16) on the shaft (18) and in step (h) removing the second half (16") of the coupling (16) together with the shaft seal (20) from the second drive shaft (18).

* * * * *